US005265337A

United States Patent [19]

Lowder

[11] Patent Number: 5,265,337

[45] Date of Patent: Nov. 30, 1993

[54] SELF-CLEANING RAZOR

[76] Inventor: Robert Lowder, 110 Argentina, Bartonville, Ill. 61607

[21] Appl. No.: 994,543

[22] Filed: Dec. 21, 1992

[51] Int. Cl.[5] ..... B26B 19/44

[52] U.S. Cl. .....30/41.5; 30/41

[58] Field of Search ..... 30/34, 41, 41.5, 133

[56] References Cited

U.S. PATENT DOCUMENTS

| | | | |
|---|---|---|---|
| 2,336,806 | 12/1943 | Schenk et al. | 30/41.5 |
| 4,205,441 | 6/1980 | Turner | 30/41.5 |
| 4,238,882 | 12/1980 | Harrison, Sr. | 30/41 |
| 4,888,868 | 12/1989 | Pritchard | 30/41 |

FOREIGN PATENT DOCUMENTS

| | | | |
|---|---|---|---|
| 279399 | 11/1951 | Switzerland | 30/41.5 |
| 2129732 | 5/1984 | United Kingdom | 30/41.5 |

*Primary Examiner*—Richard K. Seidel
*Assistant Examiner*—Paul M. Heyrana, Sr.
*Attorney, Agent, or Firm*—Philip L. Bateman

[57] ABSTRACT

A razor for removing hair from the human body self-cleans when placed under a stream of flowing water. The razor contains a water inlet located along the handle more than half-way to the head portion which is adapted to receive a stream of flowing water. The razor also contains a water outlet located in the head portion behind and in close proximity to the leading edge of the blade. An internal channel connects the water inlet to the water outlet.

4 Claims, 1 Drawing Sheet

SELF-CLEANING RAZOR

FIELD OF THE INVENTION

This invention relates to razors for removing hair from the human body. More particularly, this invention relates to self-cleaning razors.

BACKGROUND OF THE INVENTION

Razors consisting of one or more sharp metal blades in an enclosed housing with a handle are widely used for shaving, i.e., the removal of hair from the human body. Various soaps, creams, and gels are routinely used with a razor to soften the hair and help lubricate the skin. During shaving, bits of hair and other material build up in the vicinity of the blade and interfere with its ability to cut the hair. This problem is especially pronounced in razors having two parallel blades mounted in close proximity. The build-up of debris around the blade(s) is typically removed by rinsing the razor in water. However, rinsing alone is often inadequate to completely remove the debris. Several types of devices have been disclosed for more efficiently removing this type of material from razors.

One class of devices for cleaning razors are those which attach to a faucet and into which a razor is inserted. Examples of such devices are shown in d'Alaver de Costemore d'Arc, U.S. Pat. No. 4,480,387, issued Nov. 6, 1984, and Morgan, U.S. Pat. No. 4,941,492, issued Jul. 17, 1990. These devices have not achieved any significant commercial success due, in part, to their inability to work with all types of faucets and razors.

A second class of devices are razors or razor attachments which are connected to a faucet by a tube. Water from the faucet flows through the tube and out from the vicinity of the razor onto the surface being shaved. Such devices are shown in Galli, Jr., U.S. Pat. No. 4,177,556, issued Dec. 11, 1979, and Whitaker et al., U.S. Pat. No. 4,633,585, issued Jan. 6, 1987. These devices are cumbersome to use because of the tube connected to the faucet and are extremely messy because of the water flowing out of the razor.

A third class of devices are razors specifically designed to facilitate the flow of water past the blades for improved rinsing. Asano, U.S. Pat. No. 4,265,015, issued May 5, 1981, discloses a razor having a means for moving the blade back and forth which scrapes off the built-up material from the blade. Unfortunately, the moving parts themselves tend to become clogged with debris and, as a result, malfunction. Ferraro et al., U.S. Pat. No. 4,535,537, issued Aug. 20, 1985, discloses a razor having channels in the head portion which permit the flow of water over the blades. The channels do not force the flow of water in a backwash direction, i.e., the water flow is not in the direction toward the leading edge of the blade. Knauer, German Pat. No. 2514-174, issued Oct. 14, 1976, discloses a razor having a channel running through the entire length of the handle. The base of the handle is pressed against the faucet to direct water through the channel and out over the blades. Unless a perfect seal is made against the faucet, water sprays out sideways at high velocity just as occurs when one attempts to stop the flow of water from a faucet with a finger.

Accordingly, a demand exists for an inexpensive, easy-to-use, and efficient self-cleaning razor.

SUMMARY OF THE INVENTION

The general object of this invention is to provide an improved razor. A more particular object is to provide a razor which self-cleans when placed beneath a stream of flowing water.

I have invented such a self-cleaning razor. The razor contains (a) an elongated handle; (b) a head portion at one end of the handle adapted to hold at least one blade having a sharp leading edge for cutting hair; (c) a water inlet located along the handle more than half-way to the head portion adapted to receive a stream of flowing water; (d) a water outlet located in the head portion behind and in close proximity to the leading edge of the blade; and (e) an internal channel from the water inlet to the water outlet. When the water inlet of the razor is held beneath a stream of flowing water, at least a portion of the water flows through the internal channel and out over the blade to clean it of any accumulated debris.

This razor is inexpensive, has no moving parts to malfunction, is easy to use, and is highly effective at self-cleaning because the flowing water is used to backwash the material from the vicinity of the blades.

DETAILED DESCRIPTION OF THE INVENTION

Figure 1:
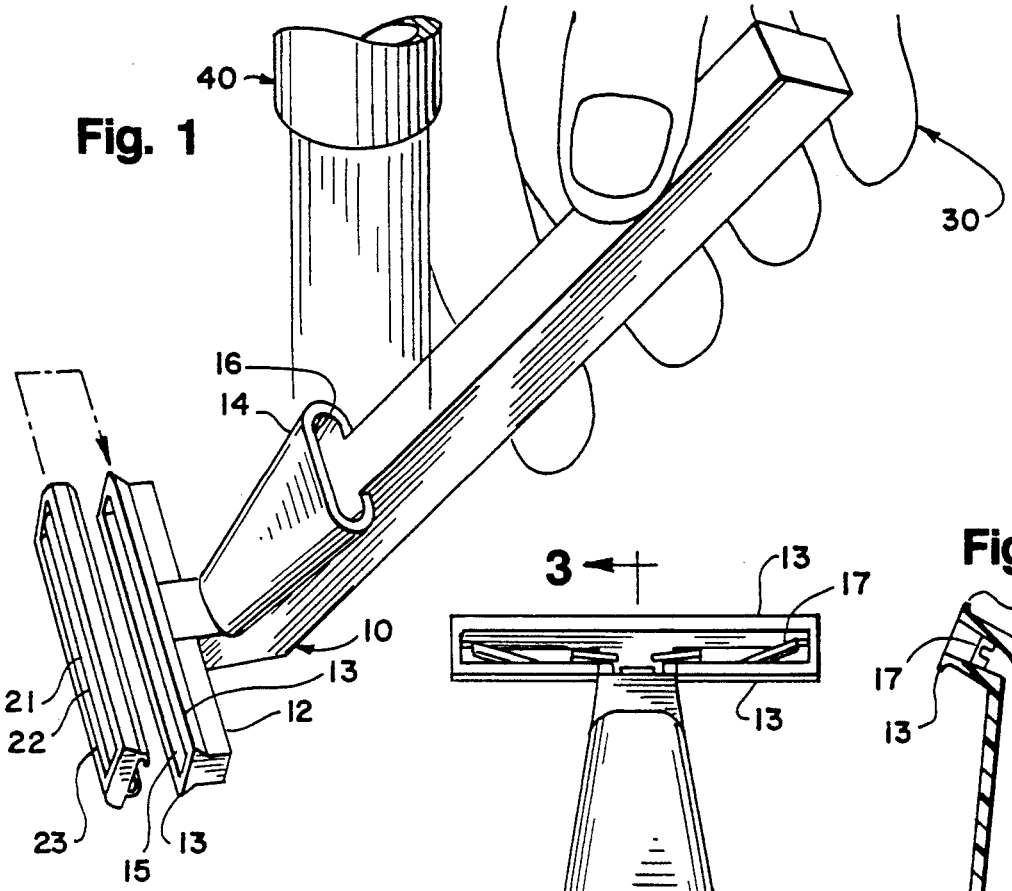
FIG. 1 is a perspective, partially-exploded view of one embodiment of the razor of this invention being held in a position to be self-cleaned by water flowing from a faucet.

This invention is best understood by reference to the drawings. FIG. 1 shows a razor 10 having a removable blade cartridge 20 being held by a man 30 in a position under a water faucet 40. When the faucet is turned on and water flows down onto the razor, it self-cleans as described in detail below.

The shaving efficiency of any razor depends, in large part, on the sharpness of its metal blade. With use, the blade inevitably dulls and must be replaced. Blade replacement is handled in three basic ways in commercial razors. One type of razor consists of a reusable handle and head assembly, typically made of stainless steel, which uses disposable metal blades. An example of this type of razor is the original safety razor invented by Gillette. A second type of razor consists of a reusable handle and head assembly which receives a disposable cartridge. The cartridge, in turn, contains the blade(s). Examples of this type of razor are the Gillette Sensor® razor and the Schick Tracer® razor. A razor of this type is shown in FIG. 1. The third type of razor consists of a disposable handle/head/blade assembly. When the blade dulls, the entire razor is discarded. All three of these blade replacement designs are suitable with the self-cleaning razor of this invention.

Shaving is generally performed in a bath, shower, or sink where water is present. As shown in FIG. 1, the man shaving is at a sink. The razor contains an elongated handle 11 and a head potion 12. The handle is typically about 4 to 5 inches long and has a cross-section and surface adapted for ease of holding. The head portion includes tracks 13 which are adapted to receive and hold the blade cartridge. The blade cartridge contains two parallel blades 21 and 22. An open space 23 exists between the two blades.

Figure 3:
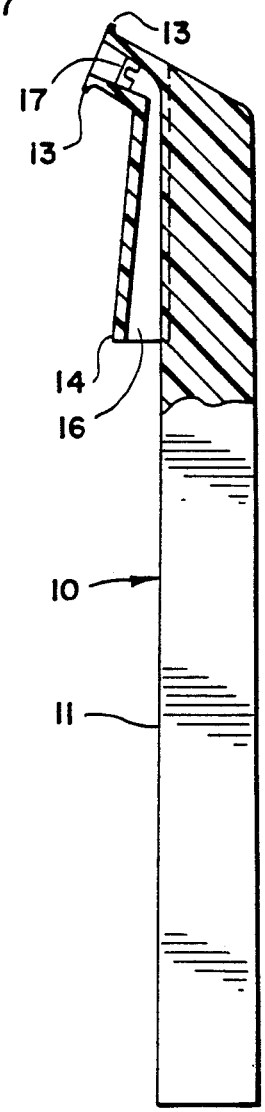
FIG. 3 is a side view, partially in section, of one embodiment of the razor of this invention.

The razor also contains a water inlet 14. The inlet is located along the handle and is positioned more than half-way to the head portion so that the razor is easily held without the hand blocking the inlet. The inlet is preferably located on the inside of the handle where it does not interfere with the use or storage of the razor. The head portion of the razor contains a water outlet 15 adjacent to the blade location. The inlet and outlet communicate through an internal channel 16, shown most clearly in the section of FIG. 3. The internal channel preferably has a decreasing cross-sectional area so that the velocity of the water increases as it flows through the channel. Increased water velocity improves the backwashing of the debris from the blade(s).

Figure 2:
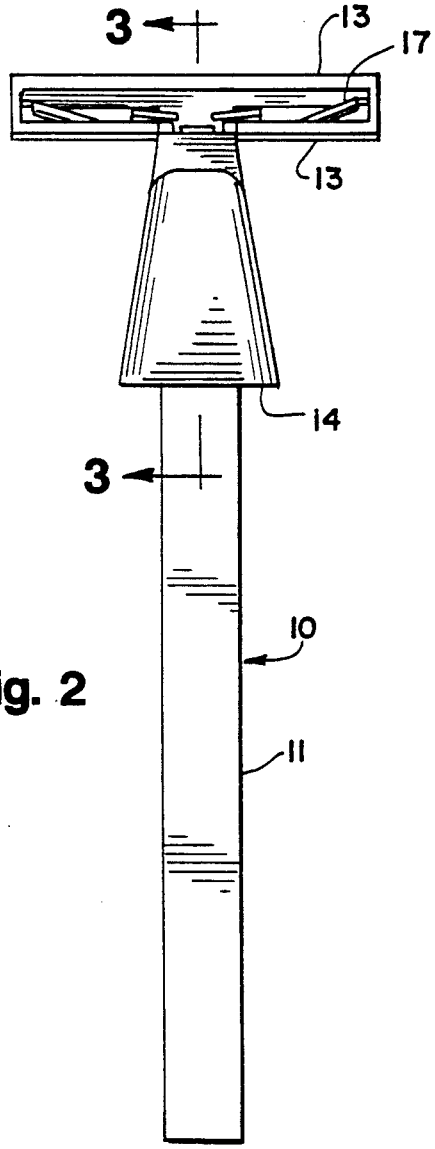
FIG. 2 is a front view of one embodiment of the razor of this invention.

The razor is used as follows. During shaving, debris builds up in the vicinity of the blade(s). To clean the razor of this debris, a stream of water is forced into the water inlet, either by placing the razor beneath a water faucet or by moving the razor in the appropriate direction through a pool of water. Water flows through the channel and out through the outlet. The outlet preferably extends most, if not all, the length of the blade. To help evenly distribute the water, it is preferable to include protrusions 17 or the like in the head portion, as shown clearly in FIG. 2.

As the water leaves the outlet, it flows through the openings of the cartridge from back to front, i.e., toward the leading edge of the blade. This backwashing with relatively high velocity water provides an extremely efficient removal of debris from the razor.

I claim:

1. A self-cleaning razor which comprises:

(a) an elongated handle;

(b) a head portion at one end of the handle adapted to hold at least one blade having a sharp leading edge for cutting hair;

(c) a water inlet located along the handle more than half-way to the head portion adapted to receive a stream of flow water;

(d) a water outlet located in the head portion behind and in close proximity to the leading edge of the blade; and (e) an internal channel from the water inlet to the water outlet; such that, when the water inlet of the razor is held beneath a stream of flowing water, at least a portion of the water flows through the internal channel and out over, and in contact with, the blade to clean it of any accumulated debris.

2. The razor of claim 1 wherein the outlet contains means for distributing the water over the length of the blade.

3. The razor of claim 2 wherein the cross-sectional area of the internal channel is less than that of the water inlet so that the water velocity increases in the channel.

4. The razor of claim 1 additionally comprising: (f) at least one blade having a sharp leading edge for cutting hair.

* * * * *